United States Patent [19]

Carr et al.

[11] 4,067,487

[45] Jan. 10, 1978

[54] COMBINATION ZIPPER AID AND SHOEHORN DEVICE

[76] Inventors: Edna J. Carr, 35 Miltenberger, Pittsburgh, Pa. 15219; Savana J. Bowes, 434 Hazel Drive, Monroeville, Pa. 15146

[21] Appl. No.: 653,275

[22] Filed: Jan. 28, 1976

[51] Int. Cl.[2] ..... A47J 51/06

[52] U.S. Cl. ..... 223/111; 24/205.15 H

[58] Field of Search ..... 223/111, 118; 24/205.15 H

[56] References Cited

U.S. PATENT DOCUMENTS 2,908,057 10/1959 Blanco ..... 223/111 X

FOREIGN PATENT DOCUMENTS 684,455 3/1930 France ..... 223/118

*Primary Examiner*—George H. Krizmanich

[57] ABSTRACT

A combination zipper aid and shoehorn device wherein a conventionally shaped shoehorn for use by the individual in slipping shoes or similar footwear onto one's foot is provided with an opening on the narrow end of the shoehorn into which is retractably fitted a device for assisting in closing or opening zippers on one's apparel. The zipper aid consists of a length of cord material provided with a hook on one end, with the cord being spring wound onto a spool contained within a housing with the housing being retractable into the end of the shoehorn for storage thereof or out of the shoehorn so that the hook on the end of the cord can be attached to a zipper tab and, using the shoehorn as a handle, enabling an individual to readily open or close the zipper on one's garment.

1 Claim, 7 Drawing Figures

FIG. 1
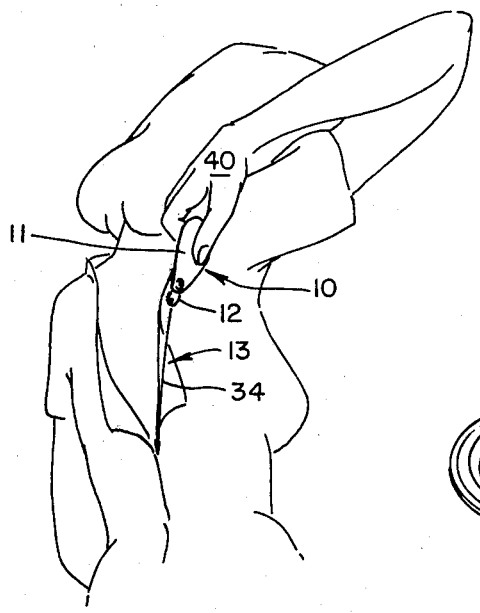
FIG. 2
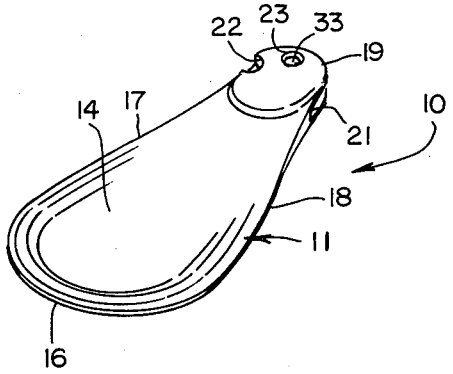
FIG. 5
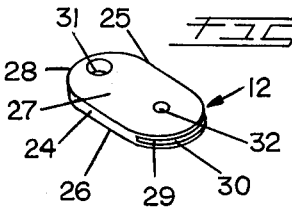
FIG. 3
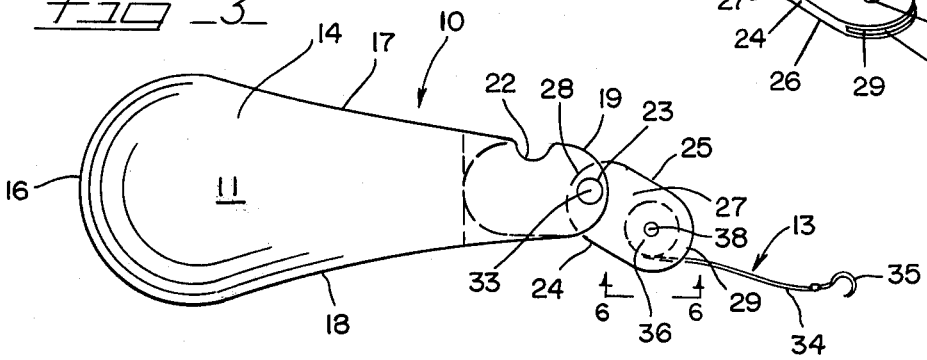
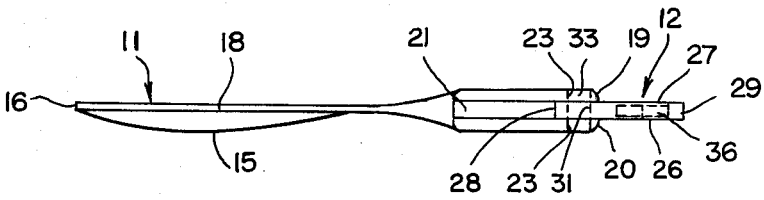
FIG. 4
FIG. 6
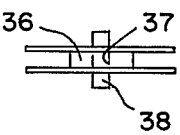

COMBINATION ZIPPER AID AND SHOEHORN DEVICE

BACKGROUND OF THE INVENTION

1. Field of the Invention

This invention relates to a combination zipper aid and shoehorn divice for use as a shoehorn or as a tool to assist in opening or closing zippers on one's garments.

2. Description of the Prior Art

It has always been a problem, particularly for women with zippers provided on the back of their garments, such as on dresses, blouses, and the like, to easily grasp the zipper tab for purposes of opening or closing zippers. This is especially true for older people or for individuals with certain ailments, such as arthritis, back problems, and the like. There are devices available on the market for assisting one to open or close zippers, such as a chain or cord securely affixed on one end to a wall or similar permanent structure with a hook on the opposite end, but these devices are either inconvenient to carry around or are complex in nature and relatively expensive to manufacture, with such devices serving merely a single function. There is, therefore, an obvious need in the marketplace for a zipper aid device which is compact as well as being combined with another convenience article, such as a shoehorn.

SUMMARY OF THE INVENTION

The present invention provides a novel combination zipper aid and shoehorn device which can be used either for assistance in slipping on shoes or other footwear or for easily opening or closing zippers provided in inconvenient places on one's garments.

It is a feature of the present invention to provide a combination zipper aid and shoehorn device.

A further feature of the present invention provides a combination zipper aid and shoehorn device which is easy to use and can be conveniently carried on one's person.

Yet still a further feature of the present invention provides a combination zipper aid and shoehorn device which is simple in construction and which, therefore, may be produced by the manufacturer at low cost.

Other features of this invention will be apparent during the course of the following description.

BRIEF DESCRIPTION OF THE DRAWINGS

In the accompanying drawings forming a part of this specification, and in which like reference characters are employed to designate like parts throughout the same:

FIG. 1 is a perspective view of the combination zipper aid and shoehorn device as being used by an individual to close a zipper on the back of one's garment; and FIG. 2 is a perspective view of the combination zipper aid and shoehorn device with the zipper aid shown in the retracted position; and FIG. 3 is a top view of the combination zipper aid and shoehorn device with the zipper aid shown in the open position; and FIG. 4 is a side view of the combination zipper aid and shoehorn device with the zipper aid shown in the open position; and FIG. 5 is a perspective view of the zipper aid housing; and FIG. 6 is a side sectional view of the zipper aid spool.

DESCRIPTION OF THE PREFERRED EMBODIMENT

Figure 7:
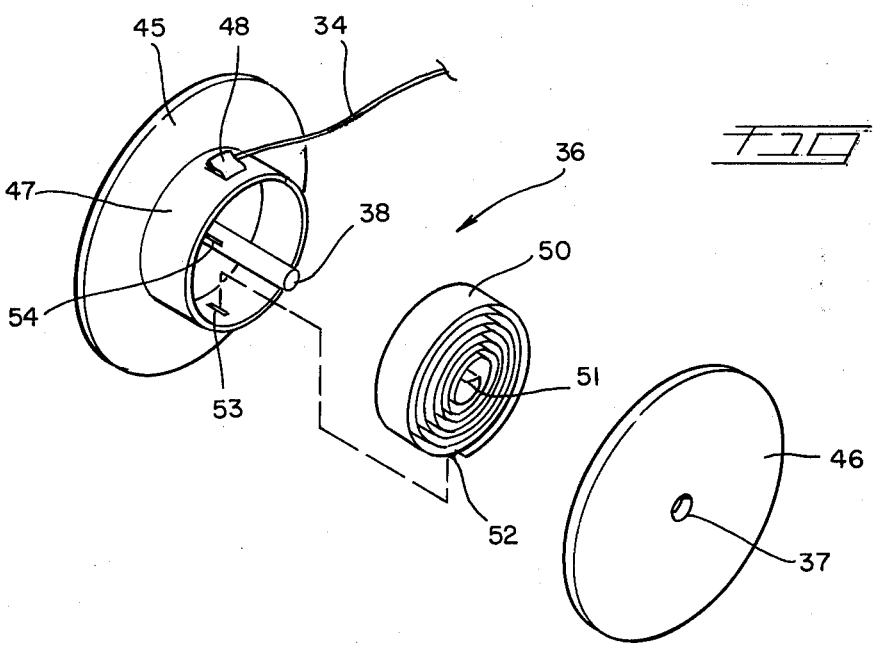
FIG. 7 is an exploded view of the zipper aid spool with the internal tension spring.

Referring now to the drawings in detail, there is illustrated a preferred form of the combination zipper aid and shoehorn device constructed in accordance with the principles of the present invention and which designated generally in its entirety by the reference numeral 10 and which is comprised of a shoehorn 11, a zipper aid housing 12, a cord assembly 13, and associated hardware and components as will be later described.

The shoehorn 11 is constructed of durable material, such as metal or plastic, and is conventional in configuration with a concave top surface 14 and a convex bottom surface 15, a rounded bottom edge 16, and two sloped side edges 17 and 18, but being further provided, as shown in FIGS. 2, 3, and 4, with two smaller rounded top edges 19 and 20 to form the opening 21 therebetween. As further shown in the drawngs, a notch 22 is provided on one side of the shoehorn and is located centrally over the opening 21, and with the round through hole 23 being provided near the round top edges 19 and 20 so as to provide a round through hole axially therethrough.

The zipper aid housing 12 is also constructed of durable material, such as metal or plastic, and consists of two parallel side walls 24 and 25, a flat bottom wall 26 being parallel to a flat top surface 27, a rounded end wall 28 and a split rounded end wall 29 which is provided with the round slit or slot 30 in the end thereof. The zipper aid housing 12 is further provided with a round through hole 31 near the end wall 28 and a smaller round through hole 32 near the end wall 29 and located centrally over the round slit 30. The zipper aid housing 12 is assembled within the opening 21 of the shoehorn 11 by axially locating the round through hole 31 to the round through hole 23 and by assembling a conventional pin or rivet 33 therethrough.

A spool 36 is positioned centrally within the round slit 30 in the zipper aid housing 12 and consists of opposed round discs 45 and 46 spaced apart but connected together by means of a round ring 47 in a conventional way, such as by adhesive, welding, or the like, with the ring 47 located centrally on the flat surfaces of discs 45 and 46. Each of the discs 45 and 46 are identical in configuration and are provided with a round through hole 37 located centrally therein. The outside of the ring 47 is provided at one point along its diameter with a tab 48. A coil spring 50 is positioned within the inside of the ring 47 so as to be disposed between the discs 45 and 46, with the spring 50 provided on its inside end with a flat portion 51 and on its outer end with a flat portion 52, the flat portion 52 being assembled within the through rectangular slot 53 provided in the ring 47 and the flat portion 51 assembled within the rectangular through slot 54 disposed lengthwise along the length of the pin 38, the pin 38 being axially disposed between the holes 37 to secure the spring 50 within the ring 47. The cord assembly 13 consists of a length of cord 34 which is of conventional cord material, such as nylon, and is approximately 24 inches or longer, an open hook 35 which is attached to one end of the cord 34 in a conventional way, such as by tying, with the opposite end of the cord being secured to the tab 48 on the spool 36 in a conventional way, such as by tying or the like, and with the spool 36 axially assembled to the round through hole 32 in the zipper aid housing 12 by means of pin 38.

In operation, when the combination zipper aid and shoehorn device 10 is used as a shoehorn for slipping on shoes or other footwear, the zipper aid housing 12 is rotated around the pin or rivet 33 so that the zipper aid housing 12 is retracted inside the opening 21 of the shoehorn 11. When using the device to assist in opening or closing a zipper, the user initially pushes the zipper aid housing 12 out of the shoehorn opening 21 by pressing the housing 12 by pushing with one's finger into the notch 22 of the shoehorn 11, then grasps the portion of the zipper aid housing 12 protruding from the opening 21 to pull the zipper aid housing 12 about the pin or rivet 33 to remove the zipper aid housing 12 out of the opening 21. The user then attaches the hook 35 into the tab of the zipper on one's garment and, as shown in FIG. 1, the shoehorn 11 is grasped within the user's hand 40 as a handle and then pulls the combination zipper aid and shoehorn device 10 up or down, depending upon whether opening or closing the zipper, the hook 35 then providing tension on the cord 34 to open or close said zipper.

When the cord 34 is pulled, the end of the cord 34 attached to the tab 48 causes the ring 47 to turn and, with the spring 50 secured therein to slots 53 and 54, simultaneously winds the spring 50 into a tightened position resulting in centrifugal tension on the ring 47 and on the cord 34 so that, when the cord 34 is released, the spring 50 will relax into its unwound state and simultaneously turn the ring 47 in the direction opposite than when the cord 34 is pulled so as to wind the cord 34 around the ring 47. When the zipper is opened or closed as desired, the zipper aid housing 12 is repositioned inside the opening 21 of the shoehorn 11 by reversing the above described procedures.

There is thus described a novel combination zipper aid and shoehorn device which can be conveniently and compactly carried on one's person and which provides a combination tool for putting on footwear or for opening and closing zippers on one's garments, particularly when the zippers are in hard to reach areas on one's garments.

It is to be understood that the form of this invention as shown and described is to be taken as a preferred example thereof, and that this invention is not to be limited to the exact arrangement of parts described in the description or illustrated in the drawings as changes thereto in the details thereof pertaining to size, shape and arrangement of parts thereof are envisioned within the scope of the invention without departing from the novel concepts of the invention.

Having thus described the invention, what is claimed is:

1. A combination zipper aid and shoehorn device which can be conveniently used by an individual for slipping on footwear or for closing or opening zippers provided in inconvenient areas on one's garments, the device comprising, in combination:

a shoehorn conventional in configuration havng a concave top surface and a convex bottom surface, a rounded bottom edge, two sloped side edges terminating at two smaller rounded top edges with an opening therebetween, a notch being further provided on one of said shoehorn edges and located centrally over said opening, and with a round through hole being provided near said rounded top edges so as to provide a round through hole axially therethrough; and a zipper aid housing consisting of two parallel side walls, a flat bottom wall parallel to a flat top surface, a rounded end wall and an opposed split rounded end wall provided with a round slot therein, said zipper aid housing being further provided with a round through hole near said end wall and a smaller round through hole near said split rounded end wall and located centrally over said round slit, said zipper aid housing assembled within said opening in said small rounded edge of said shoehorn by axially locating the larger round through hole in said housing to the round through hole in said shoehorn and by assembling a pin therethrough; and a spool consisting of opposed round discs spaced apart but connected together by means of a round ring located centrally on the flat surfaces of said discs, each of said discs being provided with a round through hole located centrally therein, with further the outside of said ring being provided at one point along its diameter with a tab, said spool being further positioned centrally within said round slit in said zipper aid housing and secured therein by means of a pin; and a coil spring positioned within the inside of said ring so as to be disposed between said discs, said spring being provided on its inside end with a flat portion and on its outer end with a flat portion, said flat portion on the outer end being assembled within a through rectangular slot provided in said ring and said flat portion of said spring on its inside end assembled within a rectangular through slot disposed lengthwise along the length of said pin; and a cord assembly consisting of a length of cord material with an open hook attached on one end of said cord in a conventional way and with the opposite end of said cord secured to said tab on said ring in a conventional way, with said cord assembly being thereby spring wound onto said spool on one end.

* * * * *